United States Patent [19]

Pound et al.

[11] Patent Number: 4,996,799

[45] Date of Patent: Mar. 5, 1991

[54] FROST-FREE SILCOCK SEAT REPAIR TOOL

[76] Inventors: Randall W. Pound, 506 S. 4th St.; William K. Baca, 8895 S. 193 E. Ave., both of Broken Arrow, Okla. 74012

[21] Appl. No.: 359,523

[22] Filed: Jun. 1, 1989

[51] Int. Cl.[5] ..... B24B 15/02

[52] U.S. Cl. ..... 51/241 VS

[58] Field of Search ..... 51/241 R, 241 S, 241 VS, 51/245; 408/83.5

[56] References Cited

U.S. PATENT DOCUMENTS

| | | | |
|---|---|---|---|
| 2,454,068 | 11/1948 | Kuhlman | 51/241 VS |
| 2,636,325 | 4/1953 | Livingston | 51/241 VS |
| 2,698,446 | 1/1955 | Apostoli | 51/241 R |
| 2,748,547 | 6/1956 | Davies et al. | 51/241 VS |
| 3,258,882 | 7/1966 | Cohen | 51/241 R |
| 3,946,526 | 3/1976 | Reutter | 51/241 VS |
| 4,833,835 | 5/1989 | Van Buren | 51/241 VS |

*Primary Examiner*—Roscoe V. Parker

*Attorney, Agent, or Firm*—Head & Johnson

[57] ABSTRACT

A tool is provided for use in repairing a silcock which has a valve stem, a washer and a valve seat axially aligned with the silcock neck with the forward face of the washer being selectively rotatably driven by the stem into and out of sealing abutment with the collar of the valve seat. The tool includes a rod with a bit end and a working end. The bit end is adapted for coupling with a drilling implement for selectively rotating the rod about its longitudinal axis. The working end has a coaxial bore. A shaft has an attachment end which is snugly insertable into the bore. Preferably, the bore and the attachment end have complimentary threads to secure the shaft to the rod. Thus this shaft will rotate coaxially with the rod. A grinding head is fixed to the free end of said shaft to rotate with it. The grinding head is shaped to slide with the shaft and the rod into the silcock neck. The grinding head has a forward grinding face contoured similar to the forward face of the washer and at least as wide as the valve seat collar to smooth the collar to sealing conformance with the washer. Preferably, the grinding face will be substantially conical and will have a knurl protruding from its tip to guide the grinding head into proper alignment on the valve seat collar. The rear edge of the grinding head may also be bevelled to prevent damage to the tool or the pipe during withdrawal from the silcock.

20 Claims, 3 Drawing Sheets

19
29
32
31
25
27
28
26
24

66
64
63
69
58
55
50
51
52
53
54

FROST-FREE SILCOCK SEAT REPAIR TOOL

BACKGROUND OF THE INVENTION

This invention relates generally to plumbing tools and more particularly concerns a tool specifically intended for the repair of frost-free silcock seats.

Frost-free silcocks, like most washered faucets or spigots, present no great difficulty in changing worn out or damaged washers. The faucet bonnet is simply removed, the stem withdrawn and the washer on the end of the stem replaced, usually involving the manipulation of a single screw. But, when the valve seat of a frost-free silcock is damaged, the problem becomes significantly more complex than is encountered with respect to other faucets or spigots.

Most other faucets would be disassembled and the damaged valve seat replaced. But the handle and spout of the frost-free silcock are mounted externally to an exterior building wall with the neck of the silcock extending through the exterior wall so that the washer and silcock seat which cooperate to close the valve are located in the interior or heated area of the building. In other words, the silcock is part of the wall construction. Consequently, in present practice, when a frost free silcock seat is damaged, it is necessary to break through the wall in order to remove the silcock. This obviously greatly increases the cost of what might otherwise be a relatively simple plumbing operation. Nevertheless, this is the common procedure followed in repairing frost-free silcock seats today. This problem could be avoided if the silcock seat could be reground and smoothed.

It is therefore an object of this invention to provide a tool which facilitates the repair of frost-free silcock seats without requiring damage to exterior or interior walls. It is also an object of the invention to provide a tool which facilitates access to a frost-free silcock seat without removing the silcock from the wall. Similarly, it is an object of this invention to provide a tool that is usable with the usual lavitory, kitchen and tub faucets as well as frost-free silcocks. It is a further object of the invention to provide a tool that will be usable by a typical homeowner as well as an experienced plumber. Another object of the invention is to provide a tool readily adaptable for use with the usual household power tools. And it is an object of the invention to provide a tool which has an easily replaceable grinding stone to prolong the life of the tool.

SUMMARY OF THE INVENTION

In accordance with this invention a tool is provided for use in repairing a silcock which has a valve stem, a washer and a valve seat axially aligned with the silcock neck with the forward face of the washer being selectively rotatably driven by the stem into and out of sealing abutment with the collar of the valve seat. The tool includes a rod with a bit end and a working end. The bit end is adapted for coupling with a drilling implement for selectively rotating the rod about its longitudinal axis. The working end has a coaxial bore. A shaft has an attachment end which is snugly insertable into the bore. Preferably, the bore and the attachment end have complimentary threads to secure the shaft to the rod. Thus this shaft will rotate coaxially with the rod. A grinding head is fixed to the free end of said shaft to rotate with it. The grinding head is shaped to slide with the shaft and the rod into the silcock neck. The grinding head has a forward grinding face contoured similar to the forward face of the washer and at least as wide as the valve seat collar to smooth the collar to sealing conformance with the washer. Preferably, the grinding face will be substantially conical and will have a knurl protruding from its tip to guide the grinding head into proper alignment on the valve seat collar. The rear edge of the grinding head may also be bevelled to prevent damage to the tool or the pipe during withdrawal from the silcock.

DRAWINGS

Other objects and advantages of the invention will become apparent upon reading the following detailed description and appended claims and upon reference to the drawings in which:

DETAILED DESCRIPTION

Figure 1:
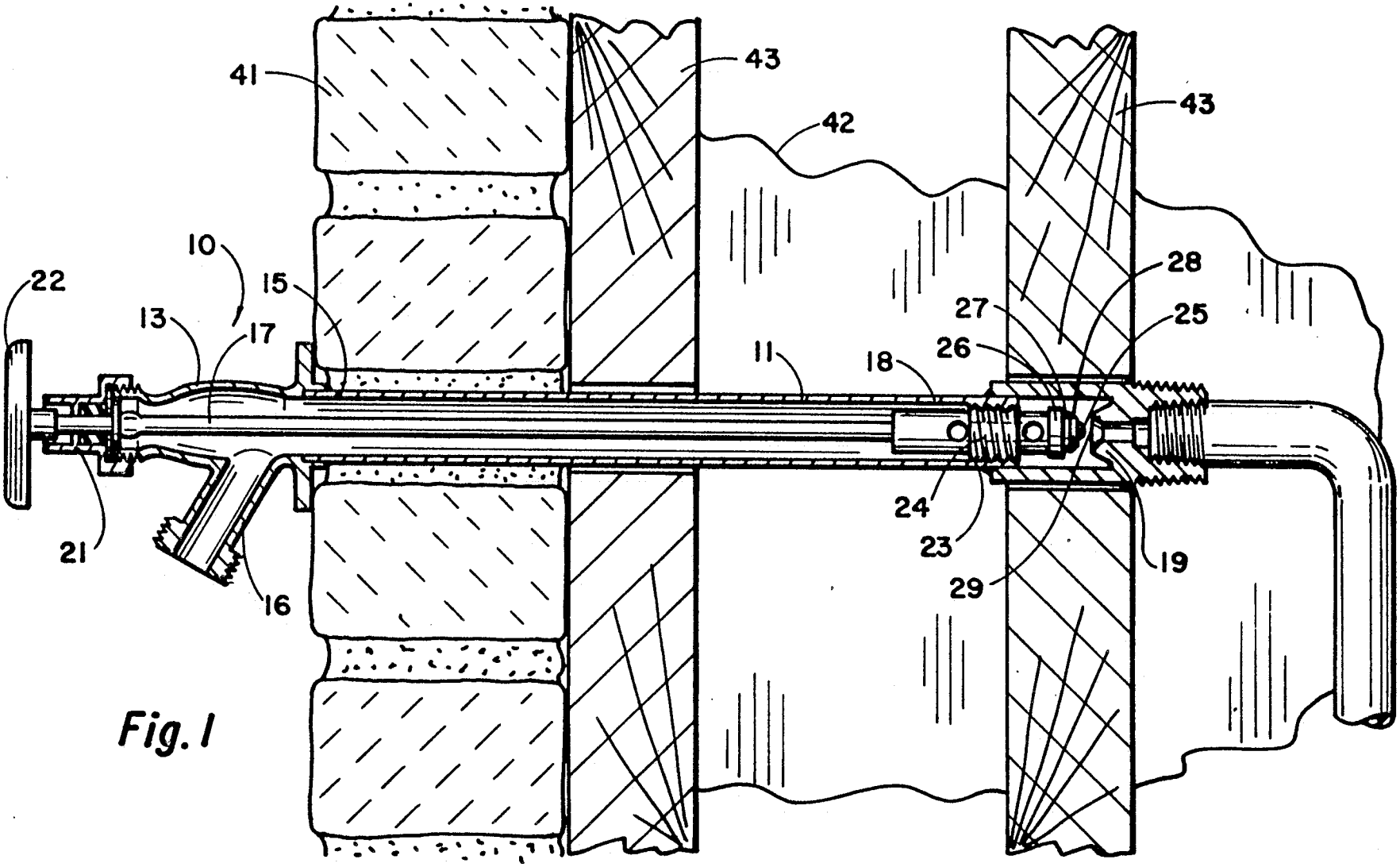
FIG. 1 is a cross-sectional view illustrating a frost-free silcock mounted in a wall.
Figures 2, 3:
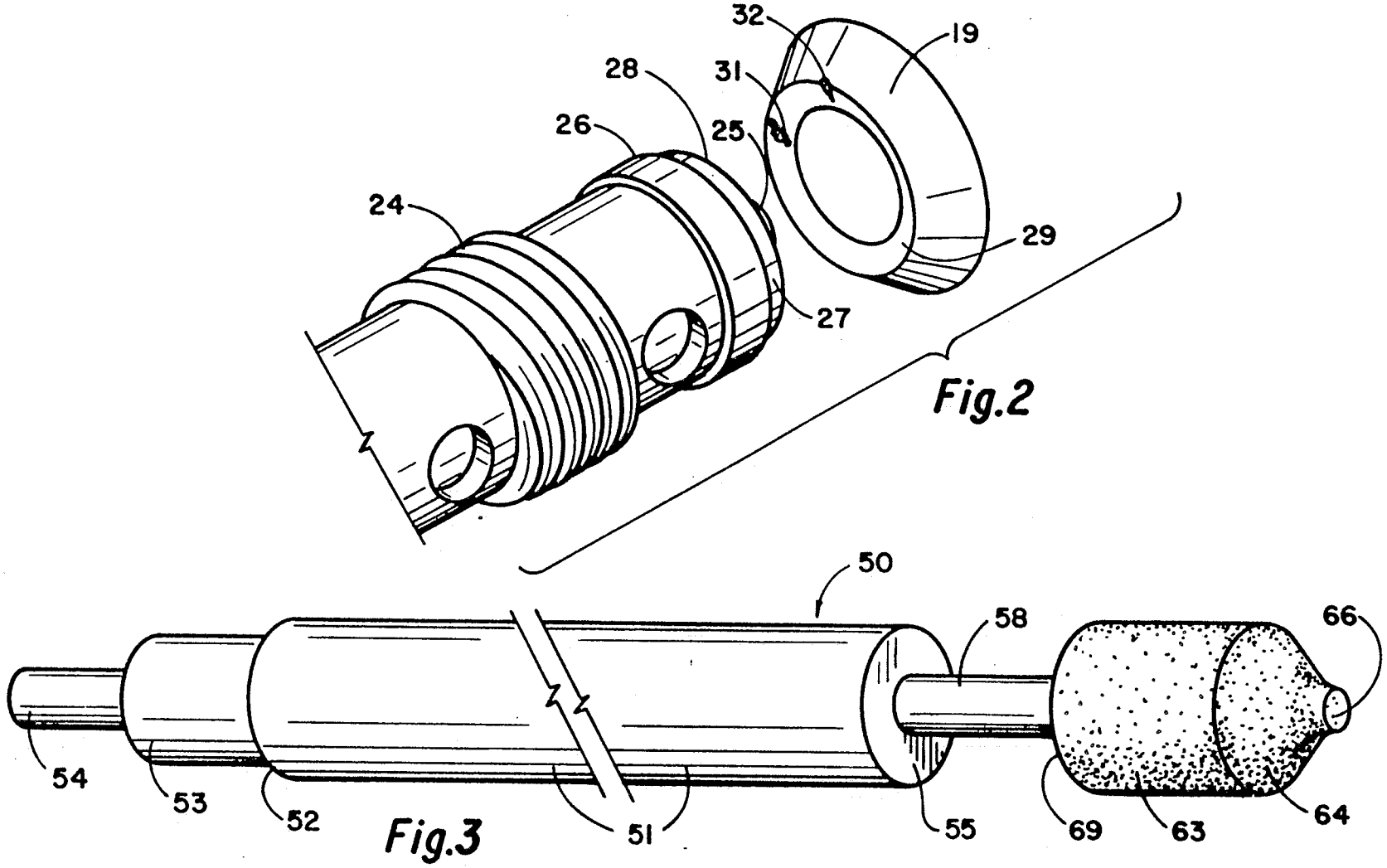
FIG. 2 is a perspective view of the valve seat of the silcock of FIG. 1, illustrating the seat in a damaged condition.
FIG. 3 is an elevation view illustrating a preferred embodiment of the tool of the present invention.

Turning first to FIG. 1, a typical frost-free silcock 10 presently available in the marketplace is illustrated. The silcock 10 essentially consists of a neck 11 which extends through a building outside wall into an interior wall. As shown, the exterior wall may for example consist of brick 41 and the interior wall of plaster board 42 on a two by four support structure 43. The faucet portion of the silcock 10 includes a substantially cylindrical body 13 threadedly connected or soldered to the exterior end 15 of the neck 11 with a cylindrical threaded spout 16 depending from the body 13. The valve stem 17 extends coaxially through the body 13 and the neck 11 to the interior end 18 of the neck 11 where the valve seat 19 is disposed. The exterior end of the valve stem 17 is journalled in a packing nut 21 or bonnet threaded to the body 12. The valve handle 22 is mounted on the exterior end of the stem 17 and is held in place by a screw 18 (not shown). Internal threading 23 in the interior end 18 of the neck 11 and external threading 24 on the interior end of the valve stem 17 cooperate to drive the stem 17 in and out in response to turning of the valve handle 22. Typically, the interior end of the valve stem 17 has a circular plate with a circumferential flange 26 in which a washer 27 is mounted by use of a screw 25 threaded into and along the longitudinal axis of the stem 17. The washer 27 has a forward face 28 designed to fit snugly into and cooperate with the exterior collar 29 of the valve seat 19. Damage to this collar 29 generally occurs when the washer 27 is worn or broken away resulting in metal to metal contact between the valve stem plate and flange 26 and the collar 29 of the valve seat 19. As shown in FIG. 2, the concave collar 29 of the valve seat 19 is designed for smooth cooperation with the convex face 28 of the washer 27. Damage to the collar 29 such as a scratch or pit 31 or a burr 32 will prevent a complete seal of the water passage and may also cause damage to replacement washers.

Figure 4:
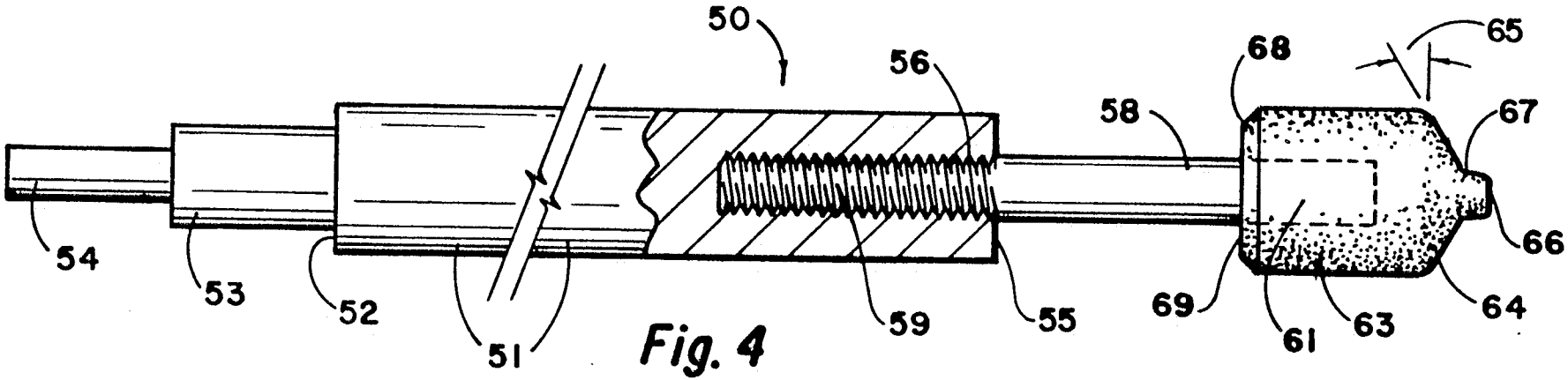
FIG. 4 is a cross-sectional view taken along line 4—4 in FIG. 3.

A preferred embodiment of the tool of the present invention for repairing a damaged valve seat is illustrated in FIGS. 3 and 4. The tool 50 consists of a rod 51 which is approximately equal in length to the distance from the packing nut 21 to the valve seat 19, generally in the range of sixteen to eighteen inches in length. The rod 51 is preferably solid and most preferably of one half inch diameter aluminum. The bit end 52 of the rod 51 is machined to concentric segments, preferably of $\frac{3}{8}''$ outer diameter 53 and $\frac{1}{4}''$ outer diameter 54, each segment being approximately $\frac{1}{2}''$ long. The working end 55 of the rod 51 includes a cylindrical bore 56 about $\frac{1}{4}''$ in diameter and centered on the longitudinal axis of the rod 51. It extends approximately $\frac{7}{8}''$ or more into the rod 51 and has a right hand threaded interior surface. The grinding portion of the tool 50 includes a steel shaft 58, preferably of $\frac{1}{4}''$ diameter and approximately 2" to 3" in length. Preferably, one end 59 of the shaft 58 is threaded for right hand rotation into the bore 56 on the rod 51 which is complimentarily threaded. The other end 61 of the shaft 58 is etched or embossed (not shown) for bonding to a cylindrical segment of grinding stone 63. This cylindrical segment 63 will preferably have an overall length of approximately 1" and a diameter of approximately $\frac{1}{2}''$.

The grinding stone can be made of any typically known grinding material available in the marketplace.

The forward face 64 of the cylindrical grinding stone 63 is conically shaped with the base angle 65 of the cone being approximately 25°. A knurl 66 about 1/16" in diameter extends from the tip of the cone 67 for approximately $\frac{1}{8}''$. A bevel 68 may also be provided on the rear face 69 of the grinding stone 63 to prevent damage to the stone 63 or the interior surface of the silcock 10 during withdrawal of the tool 10.

Figure 5:
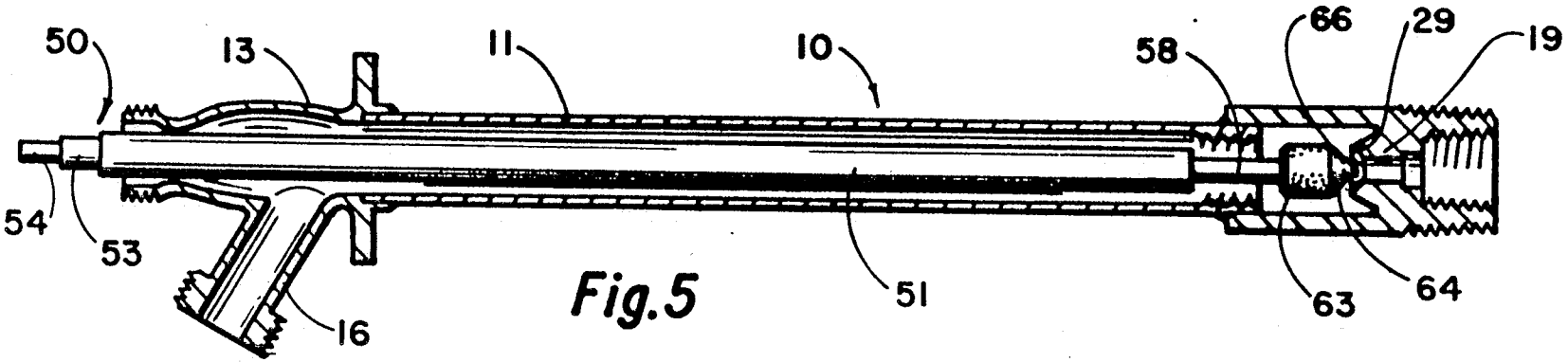
FIG. 5 is a cross-sectional view illustrating the use of the tool of FIG. 3 in the silcock of FIG. 1.

In operation in the repair of a silcock, the packing nut 21 will be removed and the valve stem 17 and washer 27 withdrawn from the neck 11 and body 13 segments of the silcock 10. The grinding portion of the tool 50 is right hand threaded into the bore 52 of the rod 51. The overall tool length will be approximately 17" to 20". The bit end 52 of the rod 51 is secured in a manual or power drill (not shown) using either the $\frac{1}{4}''$ or $\frac{3}{8}''$ bit 54 or 53. As shown in FIG. 5, the tool 50 may then be inserted into the body 13 and neck 11 of the silcock 10 until the knurl 66 guides the forward face 64 of the grinding stone 63 into a central position on the collar 29. The power source may then be energized to rotate the grinding stone 63 against the collar 29 so that the conical portion 64 of the grinding stone 63 will smooth the collar 29. The tool 10 is then withdrawn and the silcock 10 reassembled and ready for use without any damage to the building structure and without any disconnection of pipe.

Many variations in this preferred embodiment are possible. The rod 51 may be tubular rather than solid and may be of any suitable metal or plastic. The grinding stone shaft 58 may vary in length, diameter and material and may be attached in other than threading ways to the rod 51, for example, by use of a set screw. The coarseness of the grinding stone 63 may be varied depending on the skill of the workman. The face 64 of the stone 63 need not necessarily be conical but should be similar to the forward face 28 of the washer 27.

Thus, it is apparent that there has been provided, in accordance with the invention, a tool that fully satisfies the objects, aims and advantages set forth above. While the invention has been described in conjunction with a specific embodiment thereof, it is evident that the above variations together with many other alternatives and modifications will be apparent to those skilled in the art in the light of the foregoing description. Accordingly, it is intended to embrace all such alternatives, modifications and variations as fall within the spirit of the appended claims.

What is claimed is:

1. For use in repairing a silcock having a valve stem, a washer and a valve seat having a collar axially aligned within the silcock neck, the forward face of the washer being selectively rotatively driven by the stem into and out of sealing abutment with the collar of the valve seat, a tool comprising:

a shaft having an attachment end and a free end, said attachment end having means disposed thereon for coupling said shaft to a drilling implement whereby said shaft may be selectively rotated about its longitudinal axis; and grinding means fixed to said free end of said shaft for rotation therewith, said grinding means being shaped for slidable insertion with said shaft into the silcock neck and having a forward grinding face contoured similar to the forward face of the washer and at least as wide as the valve seat collar, said grinding means having an integral knurl protruding from said forward face thereof, said knurl being coaxial with said shaft and said cylindrical grinding head for maintaining said grinding means in proper alignment in the valve seat.

2. A tool according to claim 1, said grinding means comprising a cylindrical grinding head coaxial with said shaft.

3. A tool according to claim 2, said contoured forward grinding face being conical.

4. A tool according to claim 3, the base angle of said conical face being in the range of 20° to 30°.

5. A tool according to claim 3, said cylindrical grinding head having a bevelled rear edge.

6. A tool according to claim 1 further comprising means for extending said shaft, said extending means having a bit end and a working end, said working end having means disposed therein for releasably securing said shaft attachment end to said extending means and said bit end having means disposed thereon for coupling said extending means to a drilling implement whereby said shaft may be selectively rotated about its longitudinal axis.

7. A tool according to claim 6, said extending means comprising a solid rod.

8. A tool according to claim 7, said rod having a diameter in the range of $\frac{3}{8}''$ to $\frac{5}{8}''$.

9. A tool according to claim 8, said bit end having a diameter of $\frac{3}{8}''$.

10. A tool according to claim 8, said bit end having a diameter of $\frac{1}{4}''$.

11. A tool according to claim 8, said bit end having an end segment approximately $\frac{1}{2}''$ long with a diameter of $\frac{1}{4}''$ and an adjacent segment with a diameter of $\frac{3}{8}''$.

12. A tool according to claim 7, said working end securing means comprising a coaxial bore in said extending means having a diameter for snugly receiving said attachment end of said shaft therein, said bore and said attachment end having complimentary threads for clockwise rotational insertion of said attachment end into said bore.

13. A tool according to claim 6, the distance from said bit end to said grinding face being in the range of 17" to 20".

14. For use in repairing a silcock having a valve stem, a washer and a valve seat having a collar axially aligned within the silcock neck, the forward face of the washer being selectively rotatably driven by the stem into and out of sealing abutment with the collar of the valve seat, a tool comprising:

an elongated rod having a bit end and a working end, said bit end being adapted for coupling with a drilling implement for selectively rotating said rod about its longitudinal axis, said working end having a coaxial bore therein;

a shaft having an attachment end and a free end, said free end being snugly insertable into said bore;

means for securing said attachment end within said bore whereby said shaft rotates coaxially with said rod; and grinding means fixed to said free end of said shaft for rotation therewith, said grinding means being shaped for slidable insertion with said shaft and said rod into the silcock neck and having a forward grinding face, contoured similarly to the forward face of the washer and at least as wide as the valve seat collar, said grinding means having an integral knurl protruding from said forward face thereof, said knurl being coaxial with said shaft and said cylindrical grinding head for maintaining said grinding means in proper alignment in the valve seat.

15. A tool according to claim 14, said grinding means comprising a cylindrical grinding head coaxial with said shaft.

16. A tool according to claim 15, said contoured forward grinding face being conical.

17. A tool according to claim 16, the base angle of said conical face being in the range of 20° to 30°.

18. A tool according to claim 17, further comprising a knurl protruding from the tip of said conical face, said knurl being coaxial with said shaft and said cylindrical grinding head.

19. A tool according to claim 18, said cylindrical grinding head having a bevelled rear edge.

20. A tool according to claim 19, said end having a diameter in the range of $\frac{3}{8}$" to $\frac{5}{8}$", said bit end having an end segment approximately $\frac{1}{2}$" long with a diameter of $\frac{1}{4}$" and an adjacent segment with a diameter of $\frac{3}{8}$", the distance from said bit end to said grinding face body in the range of 17" to 20".

* * * * *